US007871453B2

(12) United States Patent
Vidarsson et al.

(10) Patent No.: US 7,871,453 B2
(45) Date of Patent: Jan. 18, 2011

(54) COARSE IRON OR IRON-BASED POWDER COMPOSITION CONTAINING SPECIFIC LUBRICANT

(75) Inventors: Hilmar Vidarsson, Munka-Ljungby (SE); Paul Skoglund, Leberget (SE); Sven Allroth, Höganäs (SE); Ermin Imamovic, Höganäs (SE)

(73) Assignee: Höganäs AB, Höganäs (SE)

( * ) Notice: Subject to any disclaimer, the term of this patent is extended or adjusted under 35 U.S.C. 154(b) by 0 days.

(21) Appl. No.: 12/751,133

(22) Filed: Mar. 31, 2010

(65) Prior Publication Data

US 2010/0186551 A1 Jul. 29, 2010

Related U.S. Application Data

(63) Continuation of application No. 11/578,668, filed as application No. PCT/SE2005/00580 on Apr. 20, 2005, now Pat. No. 7,758,804.

(30) Foreign Application Priority Data

Apr. 21, 2004 (SE) ..... 0401042

(51) Int. Cl.
*B22F 1/00* (2006.01)

(52) U.S. Cl. ..... 75/252

(58) Field of Classification Search ..... 75/252
See application file for complete search history.

(56) References Cited

U.S. PATENT DOCUMENTS

| | | | | |
|---|---|---|---|---|
| 3,014,825 | A | 12/1961 | Harendza-Harinxma | |
| 3,728,110 | A | 4/1973 | Klar et al. | |
| 4,002,474 | A | 1/1977 | Blachford | |
| 4,483,905 | A * | 11/1984 | Engstrom | 428/570 |
| 5,135,566 | A | 8/1992 | Sakuranda et al. | |
| 5,368,630 | A | 11/1994 | Luk | |
| 5,976,215 | A | 11/1999 | Uenosono et al. | |
| 6,372,348 | B1 | 4/2002 | Hanejko et al. | |
| 6,679,935 | B2 | 1/2004 | Hammond | |
| 7,217,310 | B2 | 5/2007 | Yahagi et al. | |
| 2001/0028859 | A1 * | 10/2001 | Ozaki et al. | 419/35 |
| 2002/0037948 | A1 | 3/2002 | Hanejko et al. | |
| 2002/0108468 | A1 | 8/2002 | Uenosono | |
| 2008/0019859 | A1 | 1/2008 | Vidarsson et al. | |

FOREIGN PATENT DOCUMENTS

| | | | |
|---|---|---|---|
| EP | 311 407 | A1 | 4/1989 |
| TW | 234098 | A4 | 11/1994 |
| WO | 2004/013067 | A2 | 2/2004 |
| WO | 2005/012566 | A1 | 11/2005 |

OTHER PUBLICATIONS

Search Report, ROC (Taiwan) Patent Application No. 094112749, Jun. 7, 2007.

* cited by examiner

*Primary Examiner*—Roy King
*Assistant Examiner*—Ngoclan T Mai
(74) *Attorney, Agent, or Firm*—Buchanan Ingersoll & Rooney PC

(57) ABSTRACT

A specifically defined powder composition is provided wherein there is a requirement that the specified lubricant always be liquid at room temperature. Such powder composition contains coarse iron or iron-based powder having an average particle size between 75 and 300 μm wherein less than 10% of the powder particles have a size below 45 μm and the amount of particles above 212 μm is above 20%, and as a lubricant at least one non-drying oil or a vegetable or animal based fatty acid having a crystalline melting point below 25° C., and a viscosity (η) at 40° C. above 15 mPas, wherein said viscosity is temperature dependent according to the following formula:

$$10 \log \eta = k/T + C,$$

wherein k is the slope, T is the temperature in degrees Kelvin, and C is a constant, in an amount between 0.04 and 0.4% by weight of the composition and optional additives. The slope preferably is above 800.

5 Claims, No Drawings

COARSE IRON OR IRON-BASED POWDER COMPOSITION CONTAINING SPECIFIC LUBRICANT

Related Applications Data

This is a continuation application of U.S. application Ser. No. 11/578,668, filed on Jan. 22, 2007 now U.S. Pat. No. 7,758,804, which is a national stage filing based on PCT International Application No. PCT/SE05/00580, filed on Apr. 20, 2005 which claims the priority of Application No. SE 0401042-7, filed in Sweden on Apr. 21, 2004, each of these prior applications is incorporated by reference herein in their entireties.

FIELD OF THE INVENTION

This invention relates to lubricants for metallurgical powder (PM) compositions. Specifically, the invention concerns iron or iron-based powder compositions including liquid lubricants.

BACKGROUND OF THE INVENTION

In industry, the use of metal products manufactured by compacting and sintering metal-powder compositions is becoming increasingly widespread. A number of different products of varying shape and thickness are being produced, and different quality requirements are placed on these products depending on their final use. In order to meet the different requirements the powder metallurgy industry has developed a wide variety of iron and iron-based powder compositions.

One processing technique for producing the parts from these powder compositions is to charge the powder composition into a die cavity and compact the composition under high pressure. The resultant green part is then removed from the die cavity. To avoid excessive wear on the die cavity, lubricants are commonly used during the compaction process. Lubrication is generally accomplished by blending a solid, particular lubricant powder with the iron-based powder (internal lubrication) or by spraying a liquid dispersion or solution of the lubricant onto the die cavity surface (external lubrication). In some cases, both lubrication techniques are utilized.

Lubrication by means of blending a solid lubricant into the iron-based powder composition is widely used and new solid lubricants are developed continuously. These solid lubricants generally have a density of about 1-2 g/cm$^3$, which is very low in comparison with the density of the iron-based powder, which is about 7-8 g/cm$^3$. Additionally, in practice the solid lubricants have to be used in amounts of at least 0.6% by weight of the powder composition. As a con-sequence the inclusion of these less dense lubricants in the composition lowers the green density of the compacted part.

Liquid lubricants in combination with iron powders for the preparation of compacted parts are disclosed in the U.S. Pat. No. 3,728,110. According to this patent it is necessary to use the lubricant in combination with a particulate porous oxide gel. Furthermore, the examples of this patent disclose that also a conventional solid lubricant (zinc stearate) is used. The iron powder tested was an electrolytic powder having a particle size less than 80 mesh (US Standard Sieve size). Also the U.S. Pat. No. 4,002,474 concerns liquid lubricants. According to this patent discrete pressure-rupturable microcapsules are used. The microcapsules comprise a core and a solid shell surrounding the core, which includes an organic liquid lubricant. In the type of lubricant system disclosed in the U.S. Pat. No. 6,679,935 a lubricant, which is solid at ambient conditions, melts upon application of pressure during the pressing of the metal parts and the lubricant system forms a liquid phase along the walls of cavity, in which the powder is being pressed. In modern PM technology, however, liquid lubricants per se have not been successful.

It has now unexpectedly been found that when iron or iron based powders of a certain type are combined with a specific type of liquid organic substances as lubricants, it will be possible to obtain compacted bodies having not only high density but it has also been found that these compacted bodies can be ejected from the dies with comparatively low ejection forces. Furthermore it has turned out that these lubricants are effective in preventing wearing of the walls of the die and the surfaces of the compacted bodies are without remarks. In contrast to the teaching in the U.S. Pat. No. 3,728,110 particulate no porous oxide gel is needed.

SUMMARY OF THE INVENTION

In brief the invention concerns a method of preparing compacted and sintered parts by using the liquid lubricant. The invention also concerns a powder composition including an iron or iron-based powder, optional alloying elements and a liquid organic lubricant.

DETAILED DESCRIPTION OF THE INVENTION

Powder Types

Suitable metal powders which can be used as starting materials for the compaction process are powders prepared from metals such as iron. Alloying elements such as carbon, chromium, manganese, molybdenum, copper, nickel, phosphorous, sulphur etc can be added as particles, prealloyed or diffusion alloyed in order to modify the properties of the final sintering product. The iron-based powders can be selected from the group consisting of substantially pure iron powders, pre-alloyed iron-based powders, diffusion alloyed iron-based iron particles and mixture of iron particles or iron-based particles and alloying elements. As regards the particle shape it is preferred that the particles have an irregular form as is obtained by water atomisation. Also sponge iron powders having irregularly shaped particles may be of interest.

As regards PM parts for high demanding applications, especially promising results have been obtained with pre alloyed water atomised powders including low amounts of one or more of the alloying elements Mo and Cr. Examples of such powders are powders having a chemical composition corresponding to the chemical composition of Astaloy Mo (1.5% Mo and Astaloy 85 Mo (0.85% Mo) as well as Astaloy CrM (3 Cr, 0.5 Mo) and Astaloy CrL (1.5 Cr, 0.2 Mo) from Höganäs AB, Sweden.

A critical feature of the invention is that the powder used have coarse particles i.e. the powder is essentially without fine particles. The term "essentially without fine particles" is intended to mean that less than about 10%, preferably less than 5% the powder particles have a size below 45 μm as measured by the method described in SS-EN 24 497. The average particle diameter is typically between 75 and 300 μm and the amount of particles above 212 μm is typically above 20%. The maximum particle size may be about 2 mm.

The size of the iron-based particles normally used within the PM industry is distributed according to a gaussian distribution curve with an average particle diameter in the region of 30 to 100 μm and about 10-30% of the particles are less than 45 μm. Thus the powders used according to the present invention have a particle size distribution deviating from that normally used. These powders may be obtained by removing the finer fractions of the powder or by manufacturing a powder having the desired particle size distribution.

Thus for the powders mentioned above a suitable particle size distribution for a powder having a chemical composition corresponding to the chemical composition of Astaloy 85 Mo could be that at most 5% of the particles should be less than 45 μm and the average particle diameter is typically between 106 and 300 μm. The corresponding values for a powder having a chemical composition corresponding to Astaloy CrL are suitably that less than 5% should be less than 45 μm and the average particle diameter is typically between 106 and 212 μm.

Lubricant

The lubricant according to the present invention is distinguished by being liquid at ambient temperature i.e. the crystalline melting point should be below 25° C.

Furthermore, the viscosity (η) at 40 C should be above 15 mPas and depending of the temperature according to the following formula:

$$10 \log \eta = k/T + C$$

wherein the slope k is preferably above 800
T is in Kelvin and
C is a constant

The types of substances fulfilling the above criteria are non drying oils, such as different mineral oils, vegetable or animal based fatty acids, such as oleic acid, but also liquid substances such as polyalkylene glycols, such as PEG 400. These lubricating oils can be used in combination with certain additives which could be referred to as "rheological modifiers", "extreme pressure additives", "anti cold welding additives", "oxidation inhibitors" and "rust inhibitors".

A lubricating amount of silane compound of the type disclosed in WO 2004/037467 may also be included in the powder mixture. Specifically the silane compound may be an alkylalkoxy or polyetheralkoxy silane, wherein the alkyl group of the alkylalkoxy silane and the polyether chain of the polyetheralkoxy silane include between 8 and 30 carbon atoms, and the alkoxi group includes 1-3 carbon atoms. Examples of such compounds are octyl-tri-metoxy silane, hexadecyl-tri-metoxy silane and polyethyleneether-trimetoxy silane with 10 ethylene ether groups.

The lubricant can make up between 0.04 and 0.4% by weight of the metal-powder composition according to the invention. Preferably the amount of the lubricant is between 0.1 and 0.3% by weight and most preferably between 0.1 and 0.25% by weight. The possibility of using the lubricant according to the present invention in very low amounts is especially advantageous since it permits that compacts and sintered products having high densities can be achieved especially as these lubricants need not be combined with a solid lubricant.

Chemically the liquid lubricant used according to the present invention might be more or less identical with organic substances used or suggested as binders in iron or iron-based compositions. However, in these cases, the compositions include a solid lubricant.

In order to obtain sintered metal parts having satisfactory mechanical sintered properties according to the present invention it may be necessary to add graphite to the powder mixture to be compacted. Thus, graphite in amounts between 0.1-1, preferably 0.2-1.0 more preferably 0.2-0.7% and most preferably 0.2-0.5% by weight of the total mixture to be compacted could be added before the compaction. However, for certain applications graphite addition is not necessary, Compaction Conventional compaction at high pressures, i.e. pressures above about 600 MPa with conventionally used powders including finer particles, in admixture with low amounts of lubricants (less than 0.6% by weight) is generally considered unsuitable due to the high forces required in order to eject the compacts from the die, the accompanying high wear of the die and the fact that the surfaces of the components tend to be less shiny or deteriorated. By using the powders and liquid lubricants according to the present invention it has unexpectedly been found that the ejection force is reduced at high pressures, above about 800 MPa, and that components having acceptable or even perfect surfaces may be obtained also when die wall lubrication is not used. The compaction may be performed with standard equipment, which means that the new method may be performed without expensive investments. The compaction is performed uniaxially in a single step at ambient or elevated temperature. In order to reach the advantages with the present invention the compaction should preferably be performed to densities above 7.45 g/cm$^3$.

The invention is further illustrated by the following non-limiting examples.

As liquid lubricants substances according to table 1 below was used;

TABLE 1

| Lubricant | Type | Trade name |
|---|---|---|
| A | Polyethylene glycol, molecular weight 400 | PEG 400 |
| B | Spindle oil | |
| C | Synthetic ester- based drawing oil | Nimbus 410 |
| D | Transmission oil | Hydro Jolner |
| E | Partly synthetic motor oil | Fricco 10W/40 |
| F | Ester based cutting oil | Cutway Bio 250 |
| G | Rape seed oil | |
| H | Polysiloxan, viscosity 100 mPas at 20 C. | Silcone oil 100 |

The following table 2 shows the viscosity at different temperatures of the liquid lubricants used;

TABLE 2

| | Viskosity η (mPa · s) | | | | | | | |
|---|---|---|---|---|---|---|---|---|
| T (° C.) | A | B | C | D | E | F | G | H |
| 30 | 73.0 | 10.7 | | 45.6 | | 72.5 | 46.9 | 88.0 |
| 40 | 47.0 | 7.7 | 78.3 | 31.4 | 85.4 | 50.2 | 32.7 | 73.2 |
| 50 | 32.0 | 5.9 | 53.0 | 21.6 | 56.5 | 35.8 | 24.1 | 62.5 |
| 60 | 23.0 | 4.9 | 39.0 | 15.9 | 39.1 | 26.7 | 18.0 | 52.4 |
| 70 | 17.5 | 4.0 | 30.4 | 12.1 | 28.4 | 20.6 | 14.2 | 44.8 |
| 80 | 13.5 | 3.4 | 23.1 | 9.5 | 21.4 | 16.3 | 11.5 | 39.0 |

The following table 3 discloses the temperature dependence of the viscosity

TABLE 3

| Formula: 10log η = k/T + C (T in K) | | | | | | | | |
|---|---|---|---|---|---|---|---|---|
| lubricant | A | B | C | D | E | F | G | H |
| k | 1563 | 1051 | 1441 | 1466 | 1661 | 1388 | 1308 | 759 |
| C | −3.316 | −2.462 | −2.725 | −3.189 | −3.387 | −2.732 | −2.659 | −0.561 |

non-drying lubricating oils or other liquid substances according to the invention shall have viscosity calculated according to the reported formula where the following requirement is met: k>800, and where the viscosity at 40° C. is >15 mPa·s

EXAMPLE 1

Different mixes of totally 3 kg were prepared. As the iron based powder a powder having a chemical composition corresponding to Astaloy 85 Mo and having particle size distribution according to table 4 below was used;

TABLE 4

| Particle size μm | % by weight |
|---|---|
| >500 | 0 |
| 425-500 | 1.9 |
| 300-425 | 20.6 |
| 212-300 | 27.2 |
| 150-212 | 20.2 |
| 106-150 | 13.8 |
| 75-106 | 6.2 |
| 45-75 | 5.9 |
| <45 | 4.2 |

180 grams of the iron-based powder was intensively mixed with 7.5 grams of liquid lubricants in a separate mixer, a so-called master mix was then obtained.

9 grams of graphite was added to the remaining iron-based powder in a Lödiger mixer and intensively mixed for 2 minutes. The master mix was the added and the final mix was mixed for further 3 minutes.

Carney flow and apparent density were measured for the obtained mixes according to table 5 below;

TABLE 5

| | A | B | C | D | E | F | G | H |
|---|---|---|---|---|---|---|---|---|
| Carney Flow (s/100 g | 15.4 | 14.2 | 14.9 | 14.8 | 15.6 | 15.1 | 14.4 | 12.9 |
| AD | 2.88 | 2.95 | 3.03 | 2.98 | 2.99 | 3.02 | 3.07 | 3.08 |

The obtained mixes were transferred to a die and compacted into cylindrical test samples, with a diameter of 25 mm, in a uniaxially press movement at a compaction pressure of 1100 MPa. During ejection of the compacted samples, the static and dynamic ejection forces were measured, and the total ejection energy needed in order to eject the samples from the die were calculated. The following table 6 shows ejection forces, ejection energy, green density, the surface appearance and the overall performance for the different samples.

TABLE 6

| | A | B | C | D | E | F | G | H |
|---|---|---|---|---|---|---|---|---|
| Ej. Energy J/cm$^2$ | 83 | 82 | 77 | 84 | 74 | 72 | 78 | 196 |
| Stat. Ej force KN | 23 | 32 | 24 | 27 | 23 | 23 | 21 | 51 |
| Dyn. Ej force KN | 27 | 32 | 25 | 29 | 24 | 24 | 27 | 77 |
| Surface appearance | perfect | scratched | perfect | dull slightly scratched | perfect | perfect | scratched | severe seizure |
| GD G/cm$^3$ | 7.63 | 7.61 | 7.60 | 7.59 | 7.60 | 7.60 | 7.60 | 7.61 |
| Overall performance | good | Not acceptable | good | acceptable | good | good | good | Not acceptable |

EXAMPLE 2

Three different mixes according to example 1 were prepared containing lubricants A, C, F and G and samples according to example 1 were compacted at different compaction temperatures. The following table 7 shows the ejection forces and ejection energy needed for ejection the samples from the die, the surface appearance of the ejected samples and the green density of the samples.

TABLE 7

| | Ejection engergy J/cm$^2$ | Stat Ej. force kN | Dyn. Ej force kN | Surface apperance | Green density g/cm$^3$ |
|---|---|---|---|---|---|
| C RT | 77 | 24 | 25 | perfect | 7.60 |
| 40° C. | 72 | 23 | 23 | " | 7.61 |
| 60° C. | 74 | 26 | 22 | " | 7.62 |
| 70° C. | 74 | 37 | 21 | " | 7.61 |
| A | 83 | 23 | 27 | perfect | 7.63 |
| 40° C. | 77 | 25 | 23 | " | 7.63 |
| 60° C. | 73 | 22 | 21 | " | 7.63 |
| 70° C. | 78 | 26 | 23 | " | 7.61 |
| G | 78 | 21 | 27 | scratched | 7.60 |
| 40° C. | 104 | 47 | 31 | seizure | 7.61 |
| F RT | 72 | 23 | 24 | perfect | 7.60 |
| 70° C. | 75 | 29 | 21 | " | 7.61 |

EXAMPLE 3

This example illustrates the influence of added amount of lubricant A and lubricant C on the ejection force and ejection energy needed in order to eject the compacted sample from the die as well as the surface appearances of the ejected samples. Mixes according to example 1 were prepared with the exception of that the amount of added lubricant at added levels of 0.20% and 0.15% were used. Samples according to example 1 were compacted at room temperature (RT). The following table 8 shows the ejection force and energy needed in order to eject the samples from the die as well as the surface appearances of the ejected sample.

TABLE 8

| 1100 MPa, RT | | Ej. Energy J/cm$^2$ | Stat. Ej. force kN | Dyn. Ej. force kN | Surface appearance | Green density g/cm$^3$ |
|---|---|---|---|---|---|---|
| C | 0.25% | 77 | 24 | 25 | perfect | 7.60 |
| | 0.20% | 84 | 27 | 29 | perfect | 7.62 |
| | 0.15% | 106 | 27 | 37 | slightly scratched | 7.63 |
| A | 0.25% | 83 | 23 | 27 | perfect | 7.63 |
| | 0.20% | 77 | 33 | 26 | seizure tendency | 7.63 |
| | 0.15% | 87 | 30 | 30 | seizure | 7.65 |

EXAMPLE 4

This examples illustrates the influence of the particle size distribution on the ejection force and ejection energy needed in order to eject the samples from the die and the influence of the particle size distribution on the surface appearances of the ejected sample when using liquid lubricants according to the invention.

Example 1 was repeated with the exception of that as "fine powder" Astaloy 85 Mo was used. The amount of particles with a size less than 45 μm is for Astaloy 85 Mo 20% and the amount of particles coarser than 150 μm is typically 15%.

The following table 9 shows the ejection force and energy needed in order to eject the samples from the die as well as the surface appearances of the ejected sample.

TABLE 9

| | Lubricant C | | Lubricant A | |
|---|---|---|---|---|
| | Coarse powder | Fine powder | Coarse powder | Fine powder |
| Ej. Energy J/cm$^2$ | 77 | 134 | 83 | 154 |
| Stat. Ej Force kN | 24 | 34 | 23 | 33 |
| Dyn Ej Force kN | 25 | 55 | 27 | 66 |
| Surface appearance | perfect | seizure | perfect | seizure |
| GD g/cm$^3$ | 7.60 | 7.56 | 7.63 | 7.56 |
| Overall performance | Good | Not acceptable | Good | Not acceptable |

From the above tables it can be seen that compositions including a coarse powder and the type of liquid lubricants defined above can be compacted to high green densities and to compacts having perfect surface finish.

EXAMPLE 5

Three five kg iron based-powder mixes were prepared. As the iron-based powder a pre-alloyed powder containing about 1.5% Cr and about 0.2% Mo, having a coarse particle size distribution with about 3% less than 45 μm, and about 30% above 212 μm.

Two test mixes were prepared, test mix 1 contained, apart from the iron-based powder, 0.25% of graphite, 0.15% of hexadecyl-tri-metoxy silane and 0.15% of lubricant C.

Test mix 2 contained the same material except that 0.255% of hexadecyl-tri-metoxy silane and 0.045% lubricant C were used.

In the reference mix 0.30% of hexadecyl-tri-metoxy silane as lubricating substance was used.

The obtained powder metallurgical mixtures were compacted into cylinders having a height of 25 mm and a diameter of 25 mm at three different compaction pressures. During ejection of the components the ejection forces were measured and the total energies needed in order to eject the components from the die were measured. The following table 10 shows the compaction pressures and results.

TABLE 10

| | Compaction pressure (MPa) | Ejection energy (J/cm$^2$) | Surface appearance |
|---|---|---|---|
| Test mix 1 | 700 | 73 | Perfect |
| Test mix 1 | 950 | 77 | Perfect |
| Test mix 1 | 1100 | 67 | Perfect |
| Test mix 2 | 700 | Not measured | Seizure |
| Test mix 2 | 950 | Not measured | Seizure |
| Test mix 2 | 1100 | 85 | Tendency of seizure |
| Reference | 700 | Not measured | Seizure |
| Reference | 950 | Not measured | Seizure |
| Reference | 1100 | 104 | Seizure |

As can be seen from the results in table 10 the addition of the lubricants according to the invention reduces the ejection energy and permits ejection without any seizure in comparison with result obtained with the reference samples.

EXAMPLE 6

Example 5 was repeated except that the compaction was performed at an elevated temperature of 60° C. The following table 11 shows the result.

TABLE 11

| | Compaction pressure (MPa) | Ejection energy ($J/cm^2$) | Surface appearance |
|---|---|---|---|
| Test mix 1 | 700 | 75 | Perfect |
| Test mix 1 | 950 | 63 | Perfect |
| Test mix 1 | 1100 | 57 | Perfect |
| Test mix 2 | 700 | 74 | Perfect |
| Test mix 2 | 950 | 64 | Perfect |
| Test mix 2 | 1100 | 59 | Perfect |
| Reference | 700 | Not measured | Seizure |
| Reference | 950 | Not measured | Seizure |
| Reference | 1100 | 80 | Tendency of seizure |

The positive impact of an elevated temperature during ejection is shown in table 11 both for the test sample and the reference sample.

What is claimed is:

1. A powder composition free from lubricant(s) which is (are) solid at ambient temperature containing a coarse iron or iron-based powder having an average particle size between 75 and 300 μm wherein less than 10% of the powder particles have a size below 45 μm and the amount of particles above 212 μm is above 20%, and as a lubricant at least one non drying oil or a vegetable or animal based fatty acid having a crystalline melting point below 25° C., and a viscosity (η) at 40° C. above 15 mPas, wherein said viscosity is temperature dependent according to the following formula:

$$10 \log \eta = k/T + C,$$

wherein k is the slope, T is the temperature in degrees Kelvin, and C is a constant, in an amount between 0.04 and 0.4% by weight of the composition and optional additives.

2. The powder composition according to claim 1, wherein the lubricant is selected from the group consisting of mineral oils, and vegetable or animal based fatty acids.

3. The powder composition of claim 1, further containing one or more additives selected from the group consisting of processing aids, alloying elements, and hard phases.

4. The powder composition according to claim 1, wherein k is above 800.

5. The powder composition according to claim 1, in combination with at least one additive selected from the group consisting of rheological modifiers, extreme pressure additives, anti-cold welding additives, oxidation inhibitors, and rust inhibitors.

* * * * *